US011773855B2

(12) United States Patent
Yabe et al.

(10) Patent No.: US 11,773,855 B2
(45) Date of Patent: Oct. 3, 2023

(54) GAS COMPRESSOR

(71) Applicant: Hitachi Industrial Equipment Systems Co., Ltd., Tokyo (JP)

(72) Inventors: Toshiaki Yabe, Tokyo (JP); Tomoo Suzuki, Tokyo (JP); Yuuji Itou, Tokyo (JP); Kohei Sakai, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 73 days.

(21) Appl. No.: 17/168,651

(22) Filed: Feb. 5, 2021

(65) Prior Publication Data

US 2021/0156383 A1 May 27, 2021

Related U.S. Application Data

(63) Continuation of application No. 15/761,987, filed as application No. PCT/JP2015/081914 on Nov. 13, 2015, now abandoned.

(51) Int. Cl.
*F04B 39/00* (2006.01)
*F04B 35/04* (2006.01)
(Continued)

(52) U.S. Cl.
CPC ..... *F04C 28/06* (2013.01); *F04B 27/08* (2013.01); *F04B 35/04* (2013.01);
(Continued)

(58) Field of Classification Search
CPC ..... F04C 28/06; F04C 28/08; F04C 28/24; F04C 18/16; F04C 2240/40; F04B 49/03; F04B 49/08; F04B 49/20
See application file for complete search history.

(56) References Cited

U.S. PATENT DOCUMENTS 4,227,862 A * 10/1980 Andrew ..... F25B 49/022 417/18
6,065,170 A 5/2000 Jang
(Continued)

FOREIGN PATENT DOCUMENTS

CN 101672271 A 3/2010
CN 102650279 A 8/2012
(Continued)

OTHER PUBLICATIONS

International Search Report (PCT/ISA/210) issued in PCT Application No. PCT/JP2015/081914 dated Mar. 1, 2016 with English-language translation (three (3) pages).
(Continued)

*Primary Examiner* — Philip E Stimpert
(74) *Attorney, Agent, or Firm* — Crowell & Moring LLP

(57) ABSTRACT

In order to reduce operation in a rotation-prohibited frequency range and to prevent resonance in a gas compressor wherein inverter control is performed, this gas compressor has: a compressor main body that compresses a gas; a motor that rotationally drives the compressor main body; an inverter that changes the rotational speed of the motor; a check valve arranged downstream from the compressor main body; a pressure detection means that detects load-side pressure downstream from the check valve; and a control device that, in accordance with the pressure detected by the pressure detection means, controls the frequency output by the inverter. The control device performs a control whereby compressed gas having a prescribed pressure is generated/maintained by increasing/decreasing the frequency, and when the frequency that generates the compressed gas having the prescribed pressure includes a specific frequency, the inverter's output frequency is increased or decreased when the pressure detected by the pressure detection means reaches a pressure corresponding to a frequency that has a
(Continued)

more constant pressure width than the prescribed pressure and does not include the specific frequency.

7 Claims, 5 Drawing Sheets

(51) Int. Cl.

| | |
|---|---|
| ***F04B 49/06*** | (2006.01) |
| ***F04B 49/20*** | (2006.01) |
| ***F04C 28/06*** | (2006.01) |
| ***F04B 49/08*** | (2006.01) |
| ***F04B 27/08*** | (2006.01) |
| ***F04C 18/16*** | (2006.01) |
| ***F04C 28/08*** | (2006.01) |
| ***F04C 28/24*** | (2006.01) |

(52) U.S. Cl.
CPC ..... *F04B 39/0027* (2013.01); *F04B 49/06* (2013.01); *F04B 49/08* (2013.01); *F04B 49/20* (2013.01); *F04C 18/16* (2013.01); *F04C 28/08* (2013.01); *F04C 28/24* (2013.01); *F04C 2240/403* (2013.01); *F04C 2270/0525* (2013.01); *F04C 2270/095* (2013.01); *F04C 2270/185* (2013.01); *F04C 2270/44* (2013.01)

(56) References Cited

U.S. PATENT DOCUMENTS

| | | | | |
|---|---|---|---|---|
| 6,287,008 | B1 | 9/2001 | Nishimura et al. | |
| 6,287,088 | B1 * | 9/2001 | Nishimura | F04C 23/00 417/297 |
| 2009/0093911 | A1 | 4/2009 | Caillat | |
| 2009/0145376 | A1 * | 6/2009 | Okuda | F04D 25/04 417/1 |
| 2009/0291341 | A1 | 11/2009 | Miyata et al. | |

FOREIGN PATENT DOCUMENTS

| | | | |
|---|---|---|---|
| CN | 204344430 | U | 5/2015 |
| JP | 55-164792 | A | 12/1980 |
| JP | 4-92715 | A | 3/1992 |
| JP | 6-193579 | A | 7/1994 |
| JP | 11-257238 | A | 9/1999 |
| JP | 2000-314564 | A | 11/2000 |
| JP | 2003-49787 | A | 2/2003 |
| JP | 2004-204691 | A | 7/2004 |
| JP | 3688458 | B2 | 8/2005 |
| JP | 2009-144549 | A | 7/2009 |
| JP | 2009-281262 | A | 12/2009 |
| TW | 389820 | B | 5/2000 |
| TW | 415981 | B | 12/2000 |
| TW | I400765 | B1 | 7/2013 |
| WO | WO 00/66952 | A1 | 11/2000 |

OTHER PUBLICATIONS

Japanese-language Written Opinion (PCT/ISA/237) issued in PCT Application No. PCT/JP2015/081914 dated Mar. 1, 2016 (three (3) pages).
Chinese-language Office Action issued in counterpart Taiwanese Application No. 105136832 dated Nov. 8, 2017 with English translation (Eleven (11) pages).
Chinese-language Office Action issued in counterpart Chinese Application No. 201580083249.6 dated Nov. 13, 2018 with partial English translation (12 pages).
Extended European Search Report issued in counterpart European Application No. 15908323.7 dated Oct. 16, 2019 (nine pages).

* cited by examiner

GAS COMPRESSOR

CROSS-REFERENCE TO RELATED APPLICATIONS

This application is a continuation of U.S. application Ser. No. 15/761,987, filed on Mar. 21, 2018, which is a national stage application of International Patent Application No. PCT/JP2015/081914, filed Nov. 13, 2015, the entire disclosures of all of which are expressly incorporated by reference herein.

TECHNICAL FIELD

The present invention relates to a gas compressor, and relates to a gas compressor that performs variable speed control using an inverter.

BACKGROUND ART

A compressor is composed of a large number of members such as an electric motor and a heat exchanger in addition to a compressor main body, and accordingly has a large number of vibration modes and natural frequencies corresponding to the vibration modes from the viewpoint of vibration. For example, a variable displacement compressor, as disclosed by Patent Literature 1, can change a rotational speed in a stepless manner, and therefore the rotational frequency of a rotor or a multiple of the rotational frequency can take an infinite number of values because the rotational speed changes. Therefore, the compressor is highly likely to cause resonance with specific vibrations determined by its structure at any rotational speed. Even if the frequency band of the specific vibrations is changed by changing the stiffness of the structure, changing the masses of some members, or doing the like, this only results in a change in the resonant frequency, and it is still difficult to completely avoid the occurrence of resonance. Resonance is a phenomenon that should be avoided, because the resonance makes vibration and noise more severe and applies forcible stress to resonating members, thereby promoting fatigue.

In this regard, Patent Literature 2 discloses a method of avoiding resonance, the method including providing a rotation-prohibited speed range having a width including a rotational speed at which resonance may occur, and performing operations at a high rotational speed above and a low rotational speed below the rotation-prohibited speed range alternately in a time-dividing manner when an amount of air discharged at a rotational speed in the rotation-prohibited speed range is required. Patent Literature 2 contributes to the reliability enhancement of a compressor by maintaining the discharge pressure of the compressed gas at fixed pressure, while reducing the rotation state in the rotation-prohibited speed band.

CITATION LIST

Patent Literatures

PATENT LITERATURE 1: Japanese Patent Application Publication No. S55-164792

PATENT LITERATURE 2: Japanese Patent Application Publication No. H06-193579

SUMMARY OF INVENTION

Technical Problem

In inverter control operations to maintain a predetermined pressure according to Patent Literature 2, if the rotational speed to obtain the predetermined pressure is included in the rotation-prohibited speed range, the compressor repeats operations at a band for high rotational speed above and a band for low rotational speed below the rotation-prohibited speed range at predetermined time intervals (time-dividing manner). In other words, the rotational speed passes through the rotation-prohibited speed range at the predetermined time intervals, more specifically, every time the rotational speed is shifted between the two rotational speed ranges. This imposes a risk that resonance may occur at the predetermined time intervals determined by time division.

There is a demand for a technique to further prevent the occurrence of resonance, and to enhance the reliability of a compressor.

Solution to Problem

In order to solve the above problem, a configuration according to CLAIMS is applied, for example. Specifically, a compressor includes: a compressor main body that compresses gas; a motor that drives and rotates the compressor main body; an inverter that changes a rotational speed of the motor; a check valve that is arranged downstream of the compressor main body; pressure detection means that detects a load-side pressure downstream of the check valve; and a controller that controls an output frequency from the inverter according to the pressure detected by the pressure detection means. The controller performs control to generate and keep compressed gas with a predetermined pressure by control of increasing and decreasing the frequency. In a case where a specific frequency is included in a frequency at which to generate the compressed gas with the predetermined pressure, the controller increases or decreases the output frequency from the inverter when the pressure detected by the pressure detection means reaches a pressure which is higher or lower than the predetermined pressure by a certain pressure margin and which corresponds to a frequency not including the specific frequency.

In another configuration, a compressor includes: a compressor main body that compresses gas; a motor that drives and rotates the compressor main body; an inverter that changes a rotational speed of the motor; a check valve that is arranged downstream of the compressor main body; air release means that releases the compressed gas upstream of the check valve; pressure detection means that detects a load-side pressure downstream of the check valve; and a controller that controls an output frequency from the inverter according to the pressure detected by the pressure detection means. The controller controls a no-load operation to generate and keep compressed gas with a predetermined pressure by releasing the compressed gas from the air release means and decreasing the frequency. In a case where a specific frequency is included in a frequency at which to generate the compressed gas with the predetermined pressure, the controller increases the output frequency to a frequency where the detected pressure has a pressure width than a certain pressure margin and which does not include the specific frequency when the pressure detected by the pressure detection means is lower than the predetermined pressure, and thereafter keeps the frequency until a pressure higher than the predetermined pressure is detected.

Advantageous Effects of Invention

The present invention makes it possible to reduce the number of times that a frequency passes through a resonant frequency in a gas compressor that generates and keeps compressed gas with a predetermined pressure under inverter control, and thereby achieve significant enhancement in reliability of the gas compressor.

Other problems, configurations and effects of the present invention will be further clarified from the description provided below.

DESCRIPTION OF EMBODIMENTS

Figure 1:
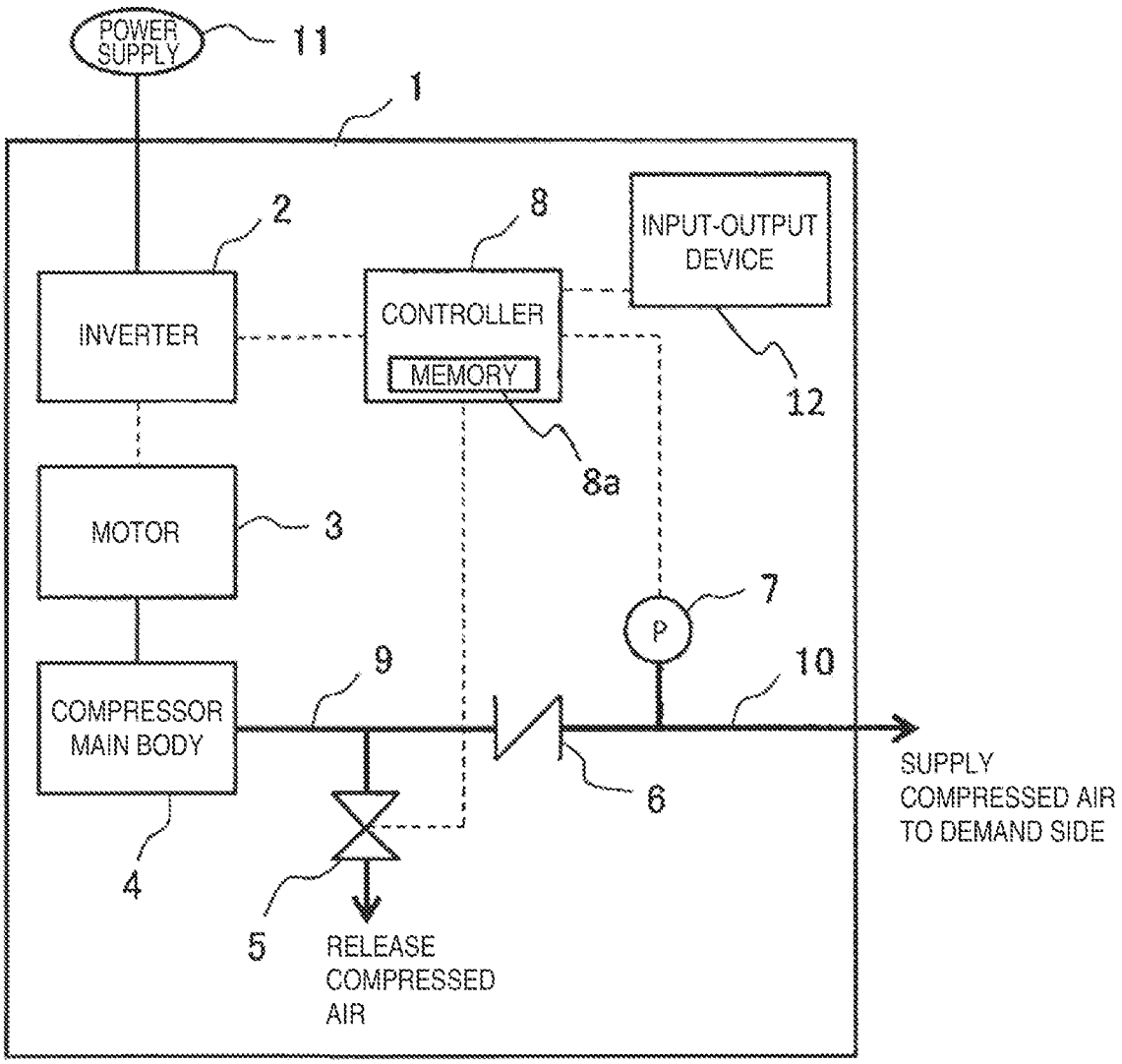
FIG. 1 is a schematic diagram illustrating a configuration of an air compressor according to an embodiment to which the present invention is applied.

Hereinafter, an air compressor 1, that is, an embodiment to which the present invention is applied, is described, by using the drawings. In the drawings, portions assigned with the same reference signs indicate the same or corresponding portions.

FIG. 1 schematically illustrates a configuration of the air compressor 1. The air compressor 1 takes in air and generates compressed air, however, is not limited to this compressor, but may also be applied to a compressor that compresses and discharges another gas without deviating from the scope of the invention.

The air compressor 1 includes: a compressor main body 4 that takes in air and generates compressed air; a motor 3 that drives the compressor main body 4; an inverter 2 that changes a frequency of power to be supplied to the motor 3; pipes 9 and 10 through which the compressed air discharged from the compressor main body 4 flows; a check valve 6 that prevents the compressed air inside the pipe 10 from flowing back into the compressor main body 4; air release means 5 that discharges the compressed air (releases the air) to the atmosphere in a no-load operation by the compressor main body 4; pressure detection means 7 that is installed inside the pipe 10 or a reservoir tank (not illustrated) connected to the pipe 10 and detects the pressure of the compressed air on a demand side (hereinafter also referred to as the "load side"); and a controller 8 that performs variable speed control of the rotational speed of the motor 3 via the inverter 2. Here, the reservoir tank is not an essential component, and the pipe 10 may be directly connected to an instrument or the like on the demand side.

The compressor main body 4 is, for example, a screw compressor including one or more screw rotors. With driving by the motor 3, the compressor main body 4 rotates the rotor to take in, compresses, and discharges the gas. Note that the present invention is not limited to this, and compressor main bodies of various types such as scroll, reciprocating, vane, and claw types may be applied to the present invention. Moreover, a so-called oil-free compressor which does not supply liquid (oil or water) to a compression work chamber is used as an example in the present embodiment, but the present invention may be also applied to a compressor of a liquid supply type.

The air release means 5 is formed of, for example, a solenoid valve, and is arranged in a pipe branched from the pipe 9. The air release means 5 "closes" the valve in a load operation of the compressor main body 4, and "opens" the valve to release the compressed air upstream of the check valve 6 to the atmosphere in a no-load operation of the compressor main body 4.

Here, the load operation is defined as an operation, provided that P denotes a set pressure needed on the load side, to perform control of increasing a rotational frequency when the pressure detected by the pressure detection means 7 falls below P, and decreasing the rotational frequency when the detected pressure exceeds P, that is, an operation of keeping the set pressure P by changing the rotational frequency with reference to the set pressure P.

Meanwhile, the no-load operation is an operation to, when the pressure detected by the pressure detection means 7 reaches an upper limit pressure P2 higher than the set pressure P, drive the motor 3 with the rotational frequency decreased to a rotational frequency f0 (any lower rotational frequency or a rotational frequency of about 5 hz) while "opening" the air release means 5 to decrease the pressure on the side upstream of the check valve 6, and thereafter operate by changing the frequency with a no-load operation reference pressure $P1+\Delta P1a$ ($P1<P1+\Delta P1a<Pt$) used as a threshold pressure so as to keep the no-load operation reference pressure.

Here, another configuration to implement the no-load operation may further include an intake throttle valve or the like on an air-intake side of the compressor main body 4, and additionally use "opening-closing" operations of this valve.

The pressure detection means 7 is, for example, a pressure sensor that is arranged downstream of the check valve 6, and detects the load-side pressure P. The detection signal is transmitted to the controller 8.

The controller 8 is implemented by collaboration of an arithmetic circuit such as a CPU or MPU, for example, with a program, and is configured to execute various kinds of controls. The controller 8 transmits a frequency conversion signal to the inverter 2 according to the load-side pressure P detected by the pressure detection means 7, and thereby controls the rotational speed of the motor 3. For example, the controller 8 changes the frequency such that the load-side pressure P detected by the pressure detection means 7 keeps P=Pt where Pt denotes a set pressure. In addition, the controller 8 can input and store the current frequency value of the inverter 2.

An input-output device 12 as input-output means is an operation display panel including a display section and an input section to be operated by a user. Through input operations by the used, a set pressure Pt, a lower limit pressure P1 and an upper limit pressure P2 under the load operation, a target keep pressure $P1+\Delta P1a$ under the no-load operation, a rotation-prohibited frequency range, various kinds of frequencies, and the like can be stored in a memory 8*a*. The display section is made capable of displaying the above various kinds of information and other various kinds of information such as the current output frequency (f), the load-side pressure P detected by the detection means, and the open/close state of the air release means, by switching over from one screen to another, presenting a list of them, or doing the like. Here, the input-output device 12 may be installed at a location remote from the air compressor 1 by coupling with a wired or wireless connection, and may include an interface that further communicates the input-output information with an external input-output device.

In this way, the controller 8 is capable of receiving signals inputted by the user through the input-output device 12, and storing and setting various kinds of parameters for operating the air compressor 1 into the memory 8*a*. For example, the set pressure Pt for keeping the necessary pressure on the load side, the upper limit pressure P2 for starting the no-load operation, the lower limit pressure P1 for returning from the no-load operation to the load operation, and the like may be set to any values according to operations by the user.

In addition, the controller 8 stores, in the memory 8*a* in advance or in response to an input operation by the user, a rotation-prohibited frequency range (specific frequency) in which a frequency or band is preferably withheld from being outputted from the inverter. The rotation-prohibited frequency range is a frequency or band in which resonance may occur. As the rotation-prohibited frequency range, a resonance frequency actually measured and examined beforehand maybe stored as a default setting, and a certain frequency may be also inputted through the input-output device 12. In the present embodiment, an operation-prohibited lower limit frequency ff1 and an operation-prohibited upper limit frequency ff2 are stored.

The configuration that allows input of a desired operation-prohibited frequency range can cope with the case where a resonance frequency is changed or newly generated due to various reasons such as aging deterioration, ambient temperature, the configurations and installation locations of a dryer and an air-oil cooler.

Figure 2:
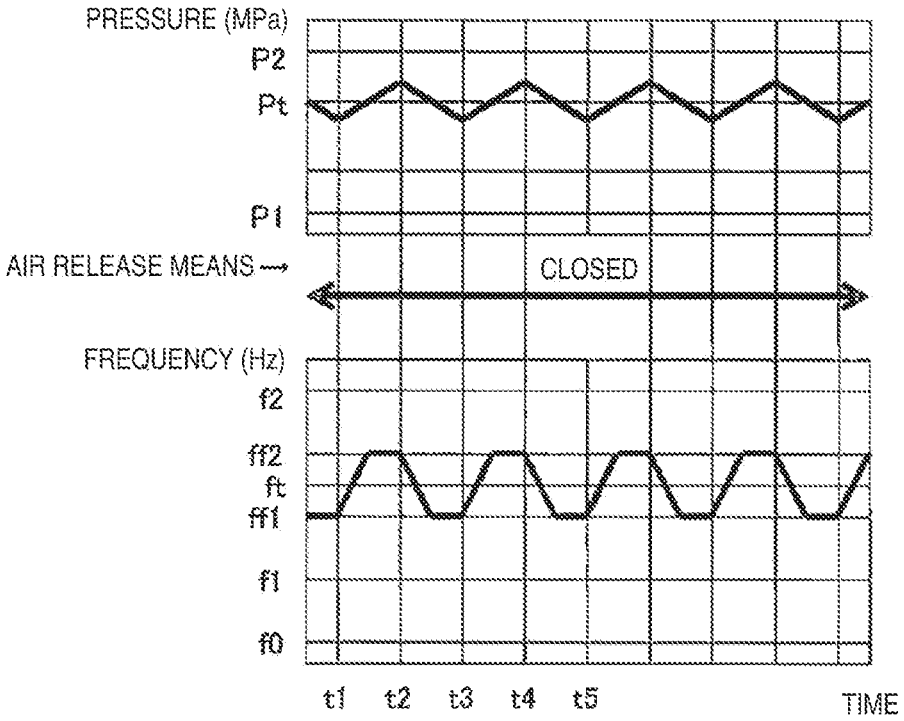
FIG. 2 is a graph presenting transitions of pressure and frequency in a load operation in the present embodiment.
Figure 3:
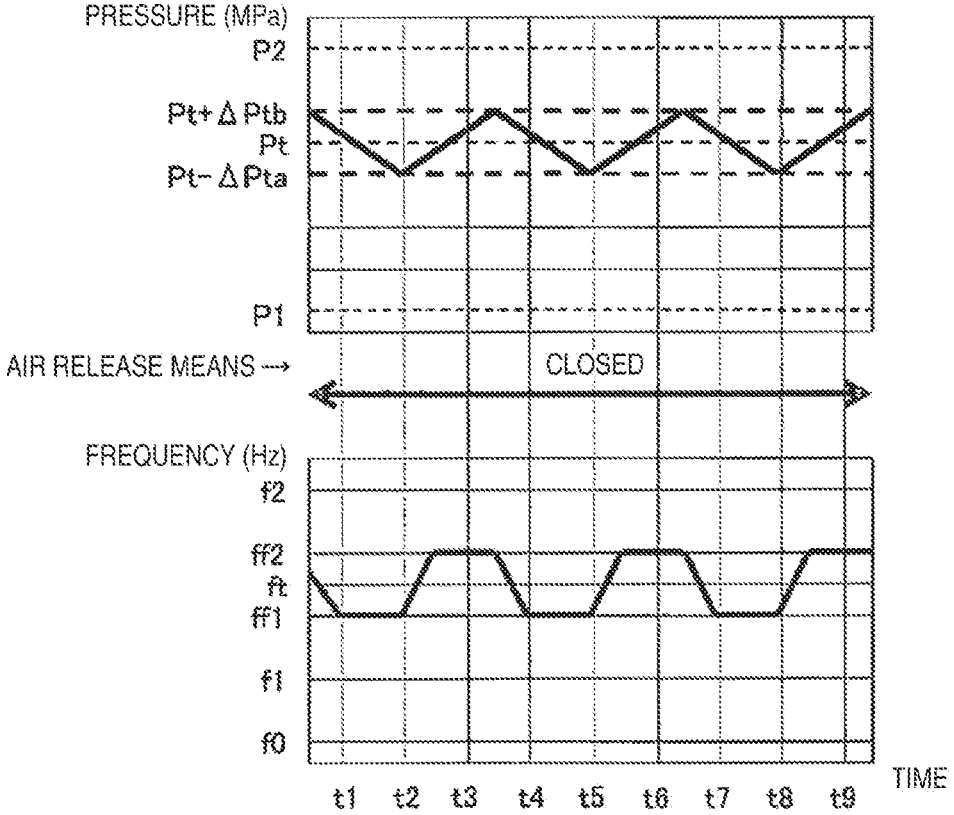
FIG. 3 is a graph presenting a case where a rotation-prohibited frequency range is included in the load operation in the present embodiment.
Figure 4:
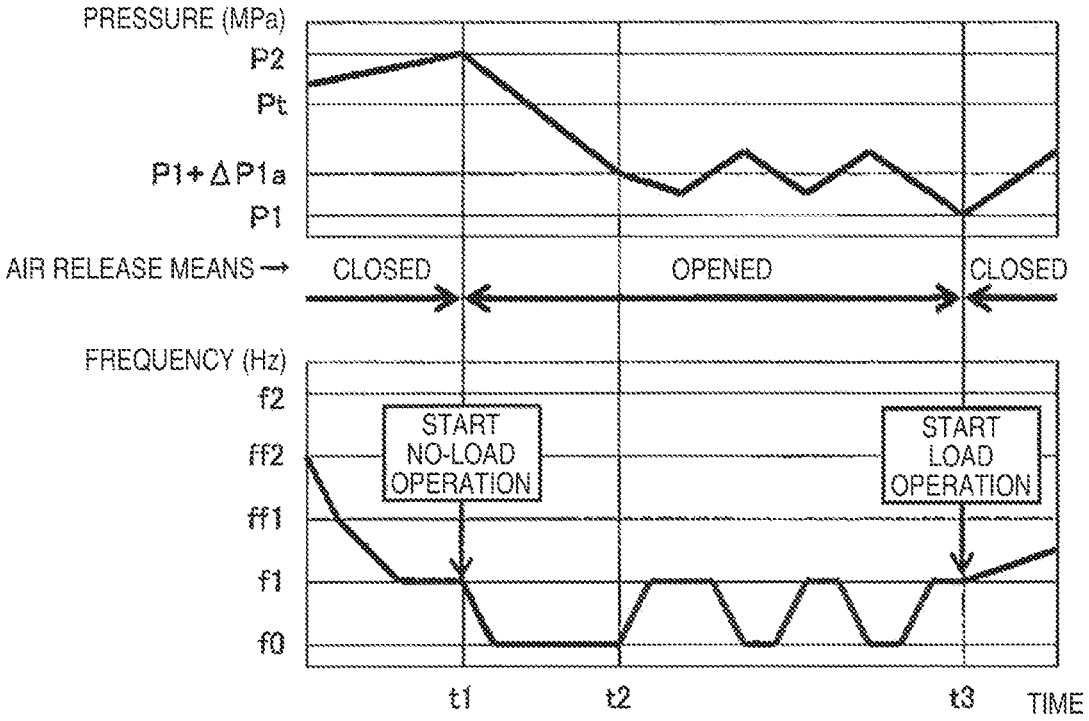
FIG. 4 is a graph presenting transitions of pressure and frequency in a no-load operation in the present embodiment.
Figure 5:
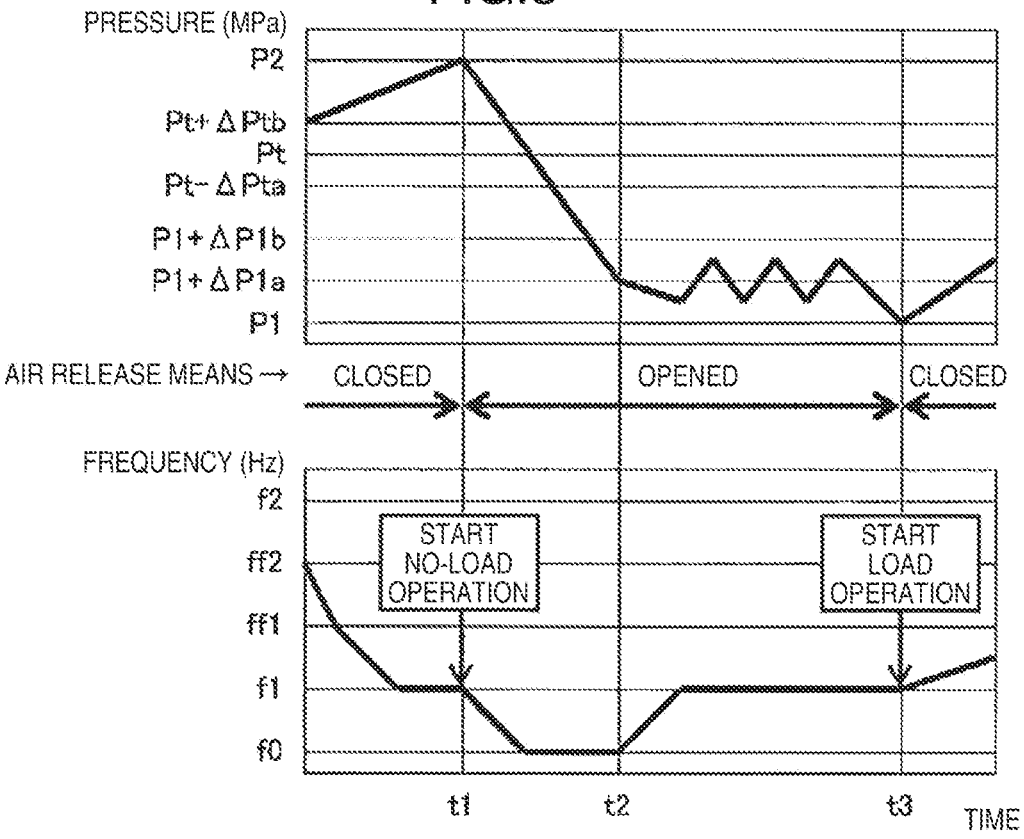
FIG. 5 is a graph presenting a case where a rotation-prohibited frequency range is included in the no-load operation in the present embodiment.

Next, using FIGS. 2 to 5, description is provided for relationships among the pressure of the compressed air, the rotational frequency, and the air release means 5 under the control of the controller 8. FIGS. 2 and 3 present the relationships under the load operation, whereas FIGS. 4 and 5 present the relationships under the no-load operation. Here, in FIGS. 2 to 5, the horizontal axis indicates time (t), the upper side line graph where the vertical axis indicates pressure (Mpa) presents a change in the load side pressure P detected by the pressure detection means 7, and a lower side line graph where the vertical axis indicates rotational frequency (Hz) presents a change in the output frequency of the inverter 2.

To begin with, the load operation is explained. FIG. 2 presents the case where the target frequency ft needed to keep the set pressure Pt is not included in the rotation-prohibited frequency range, and FIG. 3 presents the case where the target frequency is included in the rotation-prohibited frequency range.

In FIG. 2, when the rotational frequency is not included in the rotation-prohibited frequency range, the controller 8 increases and decreases the frequency so as to keep the load-side pressure P at the set pressure Pt. Specifically, when the load-side pressure P falls below the set pressure Pt at time t1 with an increase in the amount of air used on the load side, the controller 8 increases the target frequency ft to ff2, thereby raising the pressure. Thereafter, when the load-side pressure P exceeds the set pressure Pt, the controller 8 decreases the target frequency ft to ff1 at time t2, thereby decreasing the amount of compressed air generated. In sum, the controller 8 aims at keeping the set pressure Pt by repeatedly changing the frequency across a predetermined range using the set pressure Pt as the threshold pressure.

In such control, if the rotation-prohibited frequency range is between ff1 and ff2, the frequency passes through the rotation-prohibited frequency range every time the frequency is switched between the frequencies ff1 and ff2, which may result in the occurrence of resonance every time. In other words, there are many occasions on which the resonance occurs.

To address this, in the present embodiment, if the target frequency ft is within the rotation-prohibited frequency range from ff1 to ff2, control to switch the frequency to f1 or ff2 is performed with the threshold pressure for switching the frequency to ff1 or ff2 set not to the target pressure Pt but to a lower or higher pressure than the target pressure Pt. In other words, a pressure is set as a trigger for switching the frequency, and this switching pressure is provided with such a margin that occasions on which the frequency is switched can be reduced. This results in a reduction in the occasions on which the frequency passes through the rotation-prohibited frequency range, thereby making it possible to reduce the occasions on which the resonance occurs.

FIG. 3 presents the case where the pressure for frequency switching is provided with a margin. As the pressures as triggers for switching the frequency the controller 8 sets a frequency switching upper limit pressure Pt+ΔPtb and a frequency switching lower limit pressure Pt−ΔPta which are obtained by adding a pressure margin of ΔPtb to and subtracting a pressure margin of ΔPta from the set pressure Pt, respectively. The controller 8 keeps the target frequency ft at ff1 without switching to ff2 even when the load-side pressure P falls below the set pressure Pt along with a decrease in the amount of air used on the load side. Then, when the load-side pressure P reaches Pt−ΔPta at time t2, the controller 8 switches the target frequency ft from ff1 set thus far to ff2, and thereby raises the load-side pressure P. After that, the controller 8 does not switch the frequency even when the load-side pressure P exceeds the set pressure Pt, and then switches the frequency to ff1 only when the load-side pressure P reaches Pt+ΔPtb. The time at this moment is between t3 and t4.

As seen from the comparison between FIGS. 2 and 3, the occasions on which the frequency passes through the rotation-prohibited frequency range are reduced in FIG. 3 where the present embodiment is applied, and accordingly the occurrence frequency of the resonance can be reduced.

In the present embodiment, the higher and lower pressures Pt+ΔPtb and Pt−ΔPta than the set pressure Pt are set as the triggers for frequency switching. Alternatively, even when only one of the frequencies is set as a trigger, the number of occasions on which the frequency passes through the rotation-prohibited frequency range can be reduced accordingly, and thereby an effect of reducing the occurrence frequency of the resonance can be produced.

The above description is provided for the control example in the case of the load operation.

Next, the case of the no-load operation is explained. In the case where the amount of air used on the load aide becomes zero or decreased significantly even while the pressure is kept at the set pressure Pt in the load operation, the pressure sometimes rises and eventually reaches the upper limit pressure P2 (or a higher pressure). In such a case, the no-load operation is performed in which energy consumption is saved by decreasing the load applied on the compressor main body 4 and decreasing the frequency. Also in the no-lard operation, in order to keep a predetermine pressure that is lower than the set pressure Pt but not lower than the lower limit pressure P1, control to change the rotational frequency is performed by using the predetermine pressure as a threshold pressure. If a band across which the rotational frequency is changed includes the rotation-prohibited frequency range, the resonance occurs every time the frequency is switched. Also in such a case, the pressure for frequency switching is provided with a certain pressure margin, so that the occurrence frequency of resonance can be reduced.

First, FIG. 4 presents a case where a frequency band in the no-load operation does not include the rotation-prohibited frequency range.

When the load-side pressure P reaches P1+ΔPtb during driving at the frequency ff2 in the load operation, the controller 8 switches the frequency to ff1, but the pressure exceeds P1+ΔPtb and further rises as the amount of air used on the load side significantly decreases.

When the load-side pressure P reaches the upper limit pressure P2 at time t1, the controller 8 starts the no-load operation in which the load on the compressor main body 4 is decreased by switching to the minimum rotational frequency f0 and "opening" the air release means 5 to release the compressed air upstream of the check valve 6 to the atmosphere.

When the load-side pressure P falls below the target keep pressure P1+ΔP1*a* in the no-load operation at time t2 along with an increase in the amount of air consumed on the load side or the like, the controller 8 switches the frequency to the lower limit frequency f1 in the load operation to raise the pressure, and then, when the load-side pressure P exceeds P1+ΔP1*a*, switches to the minimum rotational frequency f0 to perform control to keep the pressure at P1+ΔP1*a*.

When the load-side pressure P decreases to the lower limit pressure P1 at time t3 along with an increase in the amount of air used on the load side, the controller 8 switches the control to the load operation. Specifically, the controller 8 "closes" the air release means 5, and increases the frequency to raise the pressure again to the set pressure Pt.

In such control in the no-load operation using the target keep pressure P1+ΔP1*a*, if the rotation-prohibited frequency range at which resonance may occur exists between the frequencies f0 and f1, the resonance occurs every time the frequency is switched as in the above example in the load operation.

To address this, in the present embodiment, if the rotation-prohibited frequency range exists between the frequencies f0 and f1 for use to keep the target keep pressure P1+ΔP1*a* in the no-load operation, the pressure as a trigger for switching the frequency from f1 to f0 is set to P1+ΔP1*b* that is higher than P1+ΔP1*a*, and control is performed to switch the frequency by using the pressure P1+ΔP1*b* as a threshold pressure.

FIG. 5 presents a case where a rotation-prohibited frequency range is included between the minimum rotational frequency f0 and f1 in the no-load operation.

When the load-side pressure P reaches the upper limit pressure P2 at time t1, the controller 8 "opens" the air release means 5 and switches the rotational frequency to the minimum rotational frequency f0.

When the load-side pressure P falls below the target keep pressure P1+ΔP1*a* at time t2, the controller 8 switches the frequency to f1. With this operation, the load-side pressure P starts to rise and eventually exceeds the target keep pressure P1+ΔP1*a*. Meanwhile the controller 8 keeps the frequency at f1 without switching to f0 unless the load-side pressure P reaches the higher pressure P1+ΔP1*b*.

In general, the no-load operation is started when the amount of air used on the load side tends to decrease. In addition, since an operation is performed with rotations at a low speed around the minimum frequency in the no-load operation, an amount of air discharged also decreases to a relatively small amount. With such a balance between the amount of air consumed and the amount of air discharged, the case where the load-side pressure P rises to P1+ΔP1*b* that is higher than the target keep pressure P1+ΔP1*a* has a strong tendency to occur only limitedly. By making use of this tendency, the frequency switching from f1 to f0 using the higher pressure P1+ΔP1*b* as the threshold pressure makes it possible to more decrease the number of occasions on which the frequency passes through the rotation-prohibited frequency range, and accordingly reduce the occurrence frequency of the resonance.

The above description is provided for the control example in the case where the rotation-prohibited frequency range is included between the frequencies f0 and f1 in the no-load operation.

Lastly, a flow of the forgoing processing by the controller 8 is described by using flow diagrams illustrated in FIGS. 6 to 9.

Figure 6:
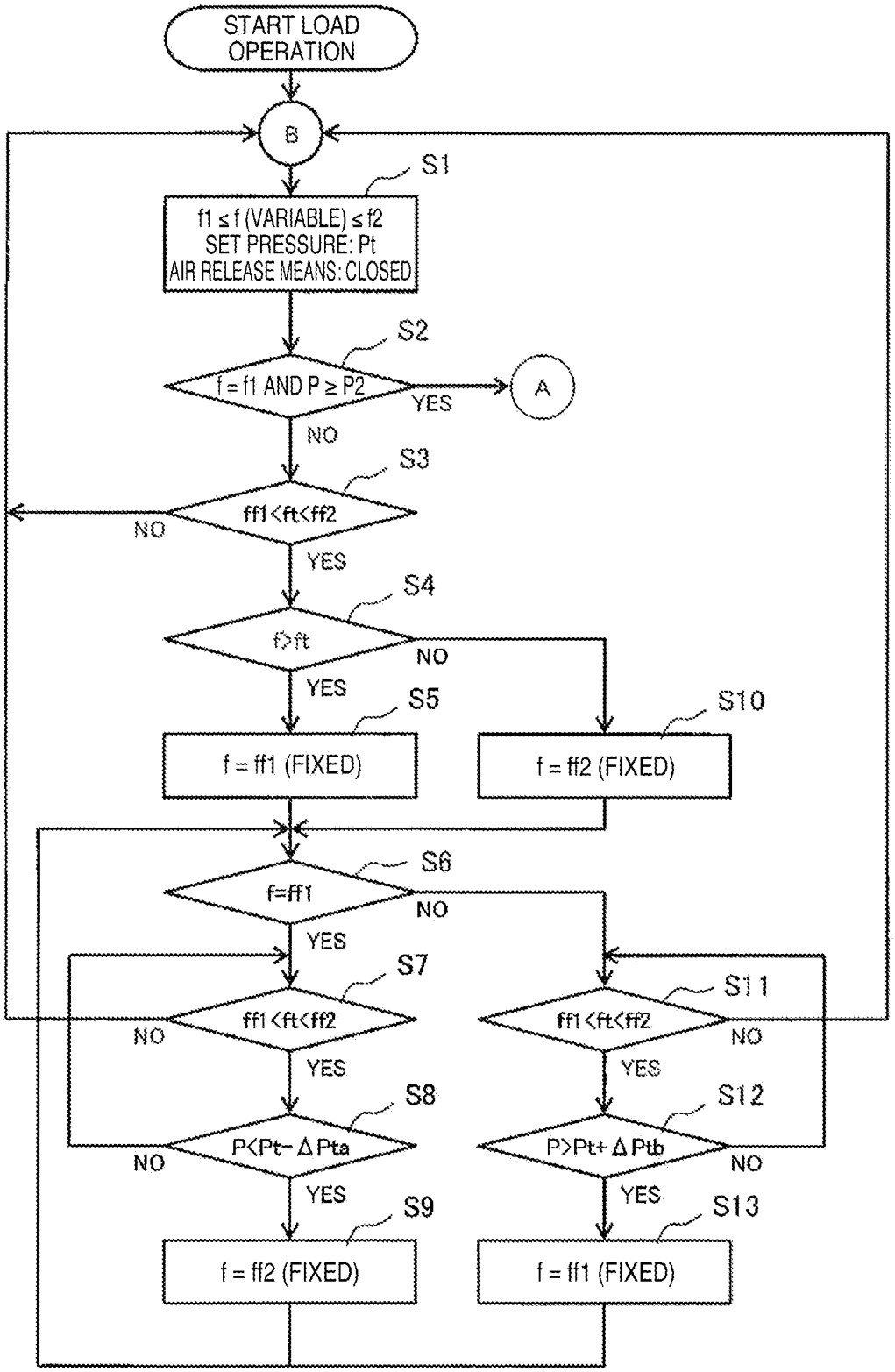
FIG. 6 is a flow diagram presenting processing in the load operation in the present embodiment.

In FIG. 6, at S1, the controller 8 sets a target frequency ft for generating an air discharge at a set pressure Pt to a value within a range of the lower limit frequency f1 in the load operation to the upper limit frequency f2 in the load operation, both inclusive, and performs the load operation via the inverter 2. In this operation, the air release means 5 is "closed."

At S2, the controller 8 determines whether the frequency f is equal to the lower limit frequency f1 in the load operation and the load-side pressure P is equal to or higher than the upper limit pressure P2. In short, this is a determination on whether or not to shift to the no-load operation. If f=f1 and P≥P2 are determined (YES), the controller 8 shifts to the no-load operation (to be described later), or if not (NO), advances to S3.

At S3, the controller 8 determines whether the target frequency ft is between the lower bound ff1 and the upper bound ff2 of the rotation-prohibited frequency range. If ff1<ft<ff2 does not hold (NO), the controller 8 returns to S1 and continues the load operation. If ff1<ft<ff2 holds (YES), the controller 8 advances to S4.

At S4, the controller 8 determines whether the frequency f is higher than the target frequency ft, and advances to S5 if f>ft holds (YES), or advances to S10 if f>ft does not hold (NO).

At S5, the controller 8 fixedly sets the frequency f to the lower bound ff1 of the rotation-prohibited frequency range. Meanwhile, at S10, the controller 8 fixedly sets the output frequency f to the upper bound ff2 of the rotation-prohibited frequency range. After S5 or S10, the controller 8 advances to S6.

At S6, the controller 8 advances to S7 if the frequency f is ff1 (YES), or advances to S11 if the frequency f is not ff1 (NO).

At S7, the controller 8 determines whether the target frequency ft is between ff1 and ff2 of the rotation-prohibited frequency range, and advances to S8 if ff1<ft<ff2 holds (YES) or returns to S1 if ff1<ft<ff2 does not hold.

At S8, the controller 8 determines whether the load-side pressure P falls below Pt−ΔPta that is the lower limit threshold pressure for frequency switching. If the load-side pressure P falls below Pt−ΔPta (YES), the controller 8 advances to S9, switches the output frequency f to ff2, and fixes the setting. Thereafter, the controller 8 returns to S6. On the other hand, if the load-side pressure P does not fall below Pt−ΔPta (NO), the controller 8 returns to S7.

Here, the explanation for S6 is again provided. When the controller 8 determines that the output frequency f is not ff1 (NO) as a result of the determination at S6, the controller 8 advances to S11 to determine whether the target frequency ft is between ff1 and ff2 of the rotation-prohibited range frequency range, and advances to S12 if ff1<ft<ff2 holds (YES). Meanwhile, if ff1<ft<ff2 holds (NO), the controller 8 returns to S1.

When the controller 8 determines at S12 that the load-side pressure P is higher than Pt+ΔPtb that is the upper limit threshold pressure for frequency switching, the controller 8 advances to S13 to switch the output frequency f to ff1 and fix the setting. Thereafter, the controller 8 again returns to S6. On the other hand, if the load-side pressure P does not exceed Pt+ΔPtb (NO), the controller 8 returns to S12.

As described above, the controller 8 determines whether or not frequency switching control for keeping the set pressure Pt in the load operation is to be done through the rotation-prohibited frequency range, and when the control is to be done through the rotation-prohibited frequency, switches the frequency by using as a trigger the lower pressure Pt−ΔPta or higher pressure Pt+ΔPtb than the set pressure Pt. Thus, the frequency within the rotation-prohibited frequency range is generated less often and thereby the resonance can be reduced.

Figure 7:
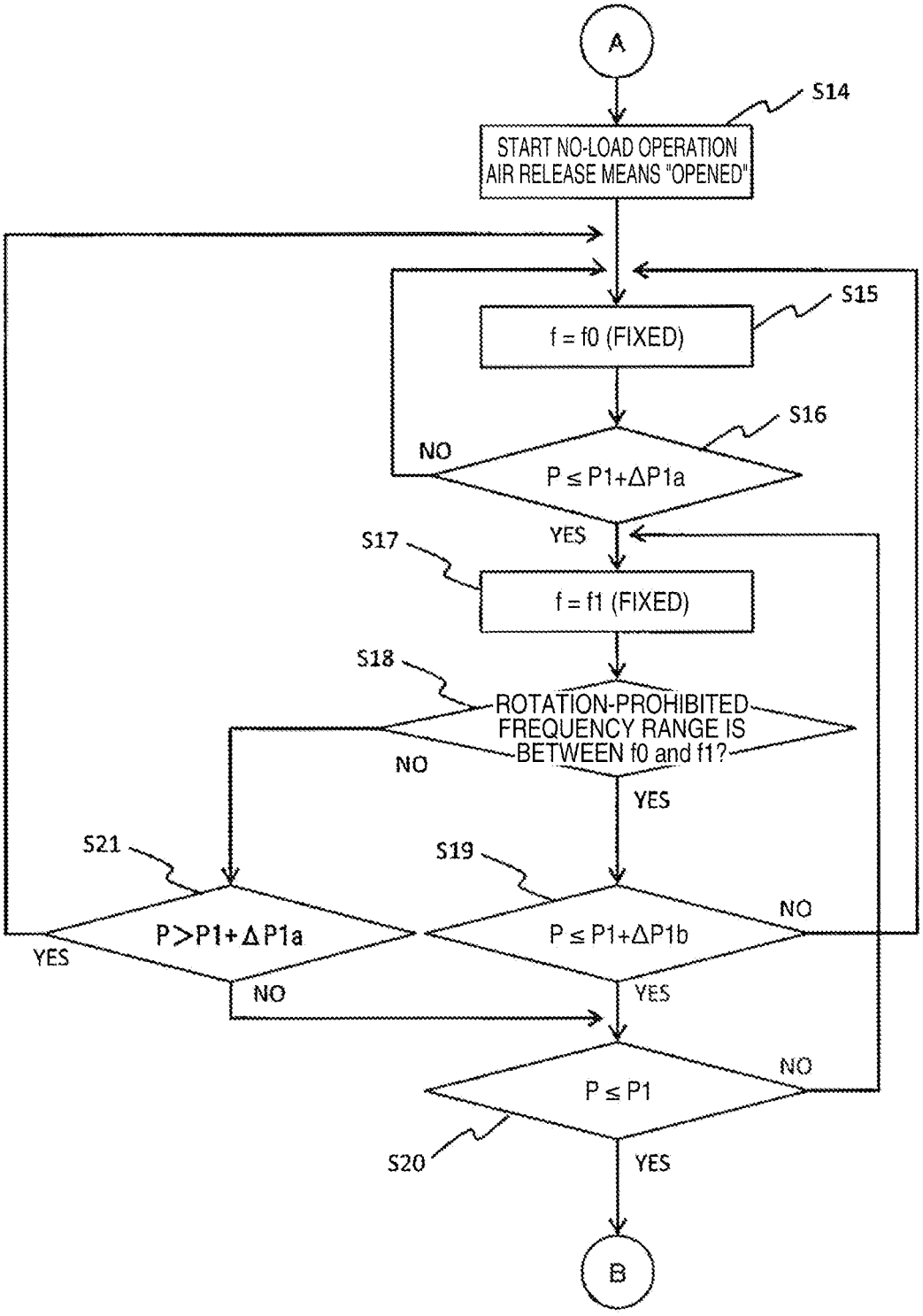
FIG. 7 is a flow diagram presenting processing in the no-load operation in the present embodiment.

Next, using FIG. 7, a processing flow in the case where to shift to the no-load operation is determined at S2 in FIG. 6.

The controller 8 "opens" the air release means 5 at S14, and fixedly sets the output frequency to the minimum rotational frequency f0 at S15.

At S16, the controller 8 determines whether the load-side pressure P is equal to or lower than the target keep pressure P1+ΔP1*a* in the no-load operation, and keeps the frequency at f0 if P≥P1+ΔP1*a* holds (NO->S15). On the other hand, if P≤P1+ΔP1*a* holds (YES), the controller 8 advances to S17 and fixedly sets the frequency f to f1.

At S18, the controller 8 determines whether the rotation-prohibited frequency range is included between the minimum rotational frequency f0 and the lower limit frequency f1 in the load operation in reference to the memory 8*a*. If the rotation-prohibited frequency range is included (YES), the controller 8 advances to S19, and determines whether or not the load-side pressure P is equal to or lower than P1+ΔP1*b* that is a pressure higher than the target keep pressure P1+ΔP1*a*. The controller 8 advances to S20 if the load-side pressure P is equal to or lower than P1+ΔP1*b*, or returns to S15 and fixedly sets the frequency f to the minimum rotational frequency f0 if the load-side pressure P is higher than P1+ΔP1*b* (NO). This is because use of a pressure higher than the target keep pressure as the threshold pressure for frequency switching can lead to a reduction in the number of occasions on which the frequency passes through the rotation-prohibited frequency range.

In addition, when determining in S18 that the rotation-prohibited frequency range is not included, the controller 8 advances to S21 and determines whether the load-side pressure P exceeds the target keep pressure P1+ΔP1*a*. The controller 8 advances to S20 if the load-side pressure P does not exceed (NO), or returns to S15 and switches the frequency to the minimum rotational frequency f0 if the load-side pressure P exceeds (YES).

At S20, the controller 8 determines whether or not the load-side pressure P is equal to or lower than the lower limit pressure P1, and returns to the load operation if the load-side pressure P is equal to or lower than the lower limit pressure P1 (YES) or returns to S17 and keeps the output frequency f fixed to f1 if the load-side pressure P is higher than the lower limit pressure P1 (NO).

The above description is provided for the processing flow in the no-load operation.

As described above, according to the present embodiment, when the rotation-prohibited frequency range is included in a frequency band across which the frequency is switched in the inverter control for keeping the load-side pressure P at a predetermined pressure such as the target pressure Pt, the frequency is switched based on a load-side pressure value which is higher or lower than the predetermined pressure by a certain pressure margin. This reduces the number of frequency switches and decreases the number of occasions on which the frequency passes through the rotation-prohibited frequency range. Accordingly, the occurrence frequency of resonance is also reduced and the reliability of the air compressor 1 can be enhanced.

Moreover, according to the present embodiment, the relationship between the rotation-prohibited frequency range and the frequency band necessary for control to keep the predetermined pressure is set dynamically. Thus, the resonance reducing effect can be obtained no matter what value is set as a predetermined pressure, such as the target pressure Pt, which can be set to any value as needed.

Similarly, according to the present embodiment, the rotation-prohibited frequency range can be set to any range as needed through the input-output device 12. Thus, the resonance reducing effect can be also obtained even if the resonance frequency band is changed or newly generated afterwards, for example, due to aging deterioration of the air compressor 1 or addition or deletion of another auxiliary instrument.

Further, according to the present embodiment, in the frequency control to keep the predetermined pressure such as the target pressure Pt, the predetermined pressure is set as the trigger for frequency switching when the rotation-prohibited frequency range is not included in a band across which the frequency control is performed. This ensures the ability to keep the predetermined pressure.

Hereinabove, the embodiment of the present invention has been described. The present invention, however, is not limited to the above various components and kinds of processing, but they may be changed in combination or modified in various ways without departing from the spirit of the present invention.

REFERENCE SIGNS LIST

1 air compressor
2 inverter
3 motor
4 compressor main body
5 air release means
6 check valve
7 pressure detection means
8 controller
8*a* memory
9, 10 discharge pipe
11 power supply
P load-side pressure
Pt set pressure
P1 lower limit pressure (in load operation)
P2 upper limit pressure (in load operation)
ΔPta lower pressure margin for Pt
ΔPtb upper pressure margin for Pt
ΔP1*a* upper pressure margin for P1
ΔP1*b* upper pressure margin for P1
f (output) frequency
ft target frequency
f0 frequency (minimum rotational frequency) in no-load operation f1 lower limit frequency in load operation
f2 upper limit frequency in load operation
ff1 lower frequency bound (for keeping pressure Pt in load operation or of a rotation-prohibited frequency range)
ff2 upper frequency bound (for keeping pressure Pt in load operation or of a rotation-prohibited frequency range)

The invention claimed is:

1. A gas compressor comprising:
a compressor main body that compresses gas;
a motor that drives and rotates the compressor main body;
an inverter that changes a rotational speed of the motor;
a check valve that is arranged downstream of the compressor main body;
pressure detection means that detects a load-side pressure downstream of the check valve; and
a controller that controls an output frequency from the inverter according to the pressure detected by the pressure detection means, wherein
the controller is configured to operate the motor at a first inverter output frequency (ff1) and a second, higher, inverter output frequency,
wherein if a resonant frequency lies between the first and second inverter output frequencies, the controller is configured to operate the motor at the first inverter output frequency if the load-side pressure is greater than a target pressure and to operate the motor at the second inverter input frequency if the load-side pressure is less than or equal to the target pressure, and subsequently to operate at the second inverter output frequency if the load-side pressure is less than or equal to a loaded operation lower threshold pressure and to operate at the first inverter output frequency if the load-side pressure is greater than or equal to a loaded operation upper threshold, and
wherein if the resonant frequency does not lie inside the range between the first and second inverter output frequencies, the controller is configured to operate the motor at the first inverter output frequency if the load-side pressure is greater than the target pressure and to operate the motor at the second inverter output frequency if the load-side pressure is less than or equal to the target pressure.

2. The gas compressor according to claim 1, further comprising an input means that inputs, to the controller, the target pressure, the resonant frequency, the first inverter output frequency, and the loaded operation upper and lower thresholds.

3. The gas compressor according to claim 1, further comprising a display means that displays the target pressure, the resonant frequency, the first inverter output frequency, and the loaded operation upper and lower thresholds.

4. A gas compressor, comprising:
a compressor main body that compresses gas;
a motor that drives and rotates the compressor main body;
an inverter that changes a rotational speed of the motor;
a check valve that is arranged downstream of the compressor main body;
air release means that releases the compressed gas upstream of the check valve;
pressure detection means that detects a load-side pressure downstream of the check valve; and
a controller that controls an output frequency from the inverter according to the pressure detected by the pressure detection means, wherein
the controller is configured to operate the motor with the air release means closed at a first inverter output frequency and a second, higher inverter output frequency by selecting one of the first and second inverter output frequencies in response a relationship between the load-side pressure and a target pressure,
wherein the controller is configured to open the air release means and to operate the motor at a minimum inverter output frequency in response to the load-side pressure reaching an upper limit pressure,
wherein if a resonant frequency is between the minimum inverter output frequency and a lower limit frequency, the controller is configured to operate the motor by switching between the minimum inverter output frequency and the lower limit frequency in response to the load-side pressure reaching an unloaded operation target pressure or an unloaded operation threshold pressure that is higher than the unloaded operation target pressure, and
wherein if the resonant frequency is not between the minimum inverter output frequency and the lower limit frequency, the controller is configured to operate the motor by switching between the minimum inverter output frequency and the lower limit frequency in response to the load-side pressure reaching the unloaded operation target pressure.

5. The gas compressor according to claim 4, wherein if the load-side pressure reaches a lower pressure limit (P1), the output frequency is increased and the air release means is closed.

6. The gas compressor according to claim 4, further comprising an input means that inputs, to the controller, unloaded operation target pressure, the resonant frequency, first inverter output frequency, and unloaded operation target pressure.

7. The gas compressor according to claim 4, further comprising a display means that displays unloaded operation target pressure, the resonant frequency, first inverter output frequency, and unloaded operation target pressure.

* * * * *